United States Patent [19]

Wolowitz

[11] 3,997,046

[45] Dec. 14, 1976

[54] FLEXIBLE CORRECTION AUXILIARIES FOR USE WITH GOLF-BALL TYPEWRITERS

[76] Inventor: William H. Wolowitz, 6905 Persimmon Tree Road, Bethesda, Md. 20034

[22] Filed: Apr. 8, 1975

[21] Appl. No.: 566,638

Related U.S. Application Data

[63] Continuation of Ser. No. 396,676, Sept. 13, 1973, abandoned.

[52] U.S. Cl. ..... 197/181; 197/156; 197/159

[51] Int. Cl.[2] ..... B41J 35/23; B41J 35/28

[58] Field of Search ..... 197/91, 151, 154, 156, 197/157, 181, 159

[56] References Cited

UNITED STATES PATENTS

| | | | |
|---|---|---|---|
| 3,397,767 | 8/1968 | Hobbs | 197/181 |
| 3,595,362 | 7/1971 | Wolowitz | 197/157 |
| 3,724,633 | 4/1973 | Korb et al. | 197/181 X |
| 3,729,081 | 4/1973 | Ozimek et al. | 197/181 X |
| 3,747,734 | 7/1973 | Norman et al. | 197/157 X |
| 3,882,990 | 5/1975 | Genesio | 197/91 X |

*Primary Examiner*—Edgar S. Burr
*Assistant Examiner*—Paul T. Sewell
*Attorney, Agent, or Firm*—William D. Hall

[57] ABSTRACT

Several typewriter auxiliaries for use with typewriters of the single-element ("golf-ball") type, to facilitate the making of corrections, either by the use of camouflage (cover-up) tapes or ribbons, or lift-off tapes. Varying degrees of automaticity are achieved in performing the correct operational sequences. In general, these auxiliaries are carried by, or supported from, the main carrier of the typewriter, which provides the travel motion of the single-element printing device in the linewise direction across the impression sheet. These auxiliaries are so designed that they are readily attachable (and removable) by the ultimate user, without the need for special tools or specialized personnel, and without any structural alteration of the typewriter.

7 Claims, 8 Drawing Figures

FIG. 4
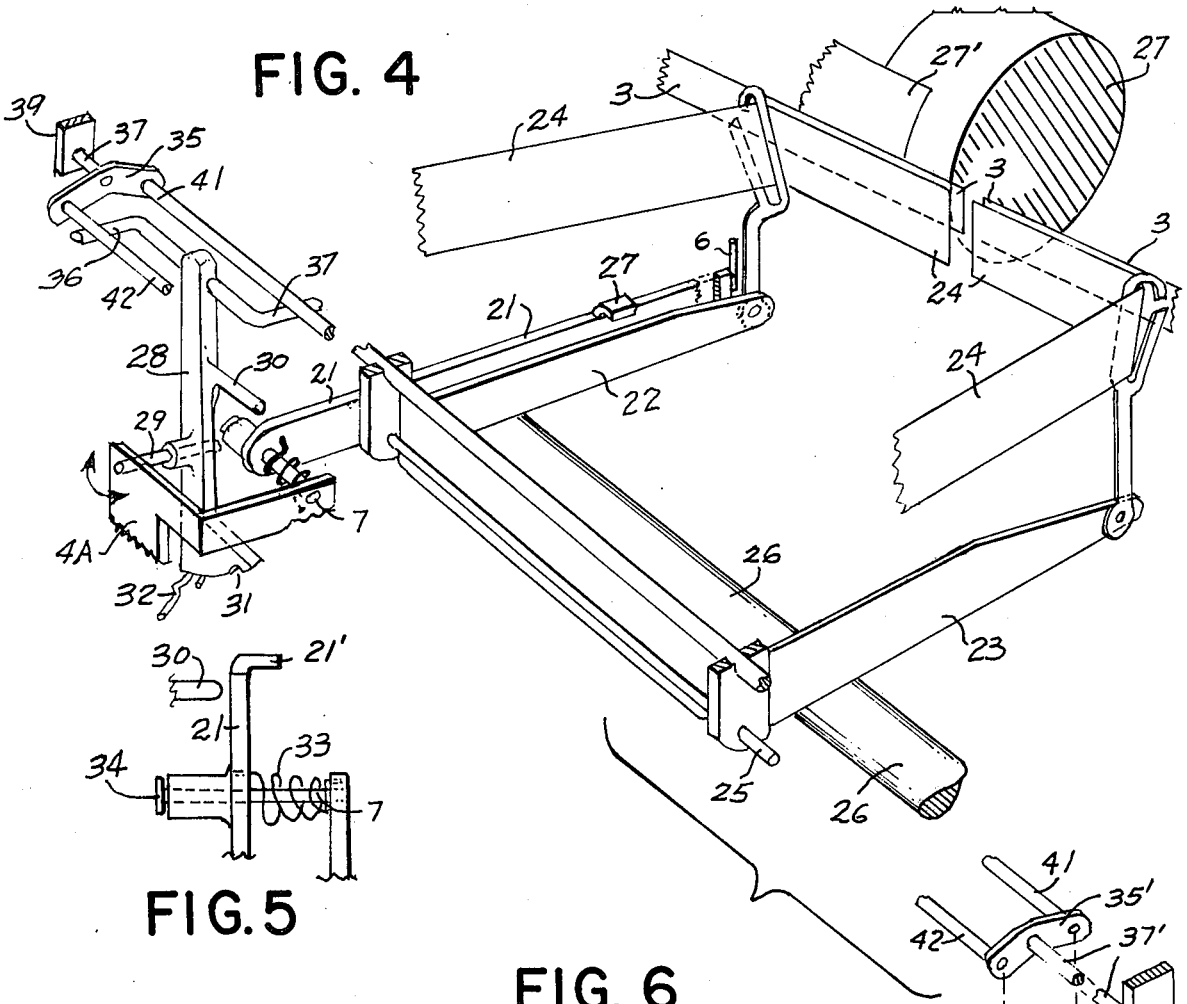
FIG. 5
FIG. 6
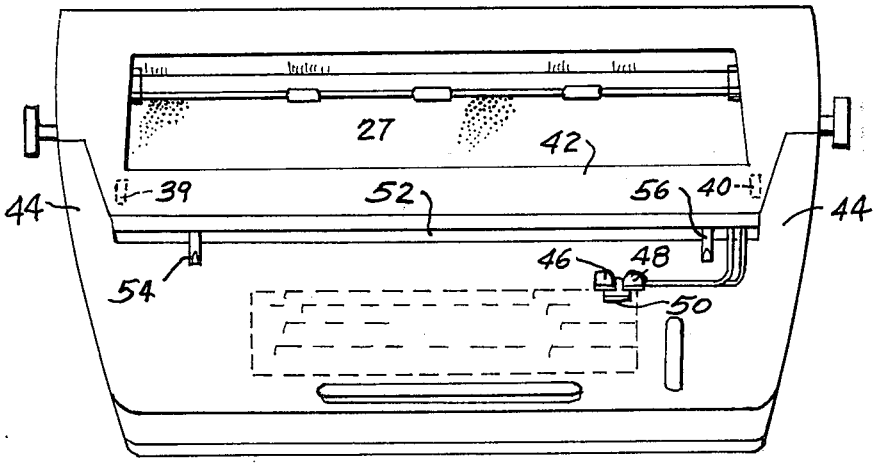

FLEXIBLE CORRECTION AUXILIARIES FOR USE WITH GOLF-BALL TYPEWRITERS

This is a continuation of application Ser. No. 396,676, filed Sept. 13, 1973, now abandoned.

BACKGROUND OF THE INVENTION

In my prior U.S. Pat. No. 3,595,362, issued on July 27, 1971, there was shown and claimed a typewriter of the single element (golf ball) type which was provided with error-correcting mechanism having a correction key associated with the keyboard, operating to control a correcting ribbon in turn associated with a marking ribbon. In several of my prior U.S. and foreign patents cited in that U.S. Pat. No. 3,595,362 or referred to therein, for example U.S. Pat. Nos. 3,114,447; 3,141,539; 3,149,711; 3,154,183 and 3,204,745, there had been shown and described various arrangements by which corrections could be accomplished in typewriters of the more common plural-element types, e. g. of the type-basket construction.

The principal commercial source of single-element typewriters has been the International Business Machines Corporation (IBM), who have marketed many thousands of such typewriters under the registered Trademark "Selectric". It is considered likely that such machines will continue in commercial use, either as new or rebuilt typewriters, or as used type-writers, for many years to come. Moreover, there has quite recently come onto the market an improved form of single-element typewriter which incorporates special features for the making of corrections; this typewriter is known by the trademark name Correcting "Selectric" Typewriter. The special features employed in this new typewriter are not themselves adaptable to the other Selectric typewriters, and it would therefore be very desirable if there were some way in which the owners of the older style single-element machines could obtain, at moderate cost, the advantages of modern error-correction operation; that is, without the cumbersome and inefficient purely manual use of error-correcting materials.

In U.S. Pat. No. 3,724,633, issued Apr. 3, 1973, to the above-mentioned company, some features of the Correcting Selectric Typewriter have been described, and also the main characteristics and differences between correction materials employed in so-called camouflage or cover-up error correction procedures, and so-called "lift-off" procedures. That U.S. Pat. No. 3,724,633 therefore, constitutes useful background information for an understanding of my present invention, whose main object is to provide owners of now conventional single-element typewriters with efficient yet relatively inexpensive error-correction facilities, easy of application to existing typewriters, and with optional degrees of automation, or what is perhaps better called "automaticity".

In summary, this invention provides add-on units or auxiliary elements or clip-on accessories, applicable in very simple ways to existing golf-ball single-element typewriters, without the need for tools or skilled mechanics, whereby provisions for error-correction may be provided at very low cost.

The auxiliaries clip onto the existing mechanism plates from above, without interfering with the usual ribbon cartridges.

The invention also contemplates that the operator will not have to raise the cover panel of the typewriter in order to control the ribbon, and can readily make corrections without having direct access to the existing ribbon controls, such as the vibrator throw control.

The auxiliary frame of the invention is applied on top of the existing mechanism plate of the machine (the ribbon cartridge being first removed), in space which is available between the existing plate and the cartridge; the ribbon cartridge is then replaced between the usual clips and guides provided for that purpose.

BRIEF DESCRIPTION OF THE DRAWINGS

FIG. 4 is a schematic perspective view, again partly broken away for clarity, of another form of the invention.

FIG. 5 is an enlarged end view showing certain parts of FIG. 4 in elevation.

FIG. 6 is a view from above of a complete typewriter incorporating the FIG. 4 form of the invention, illustrating a particular form of keyboard control of the correcting function.

Figure 1:
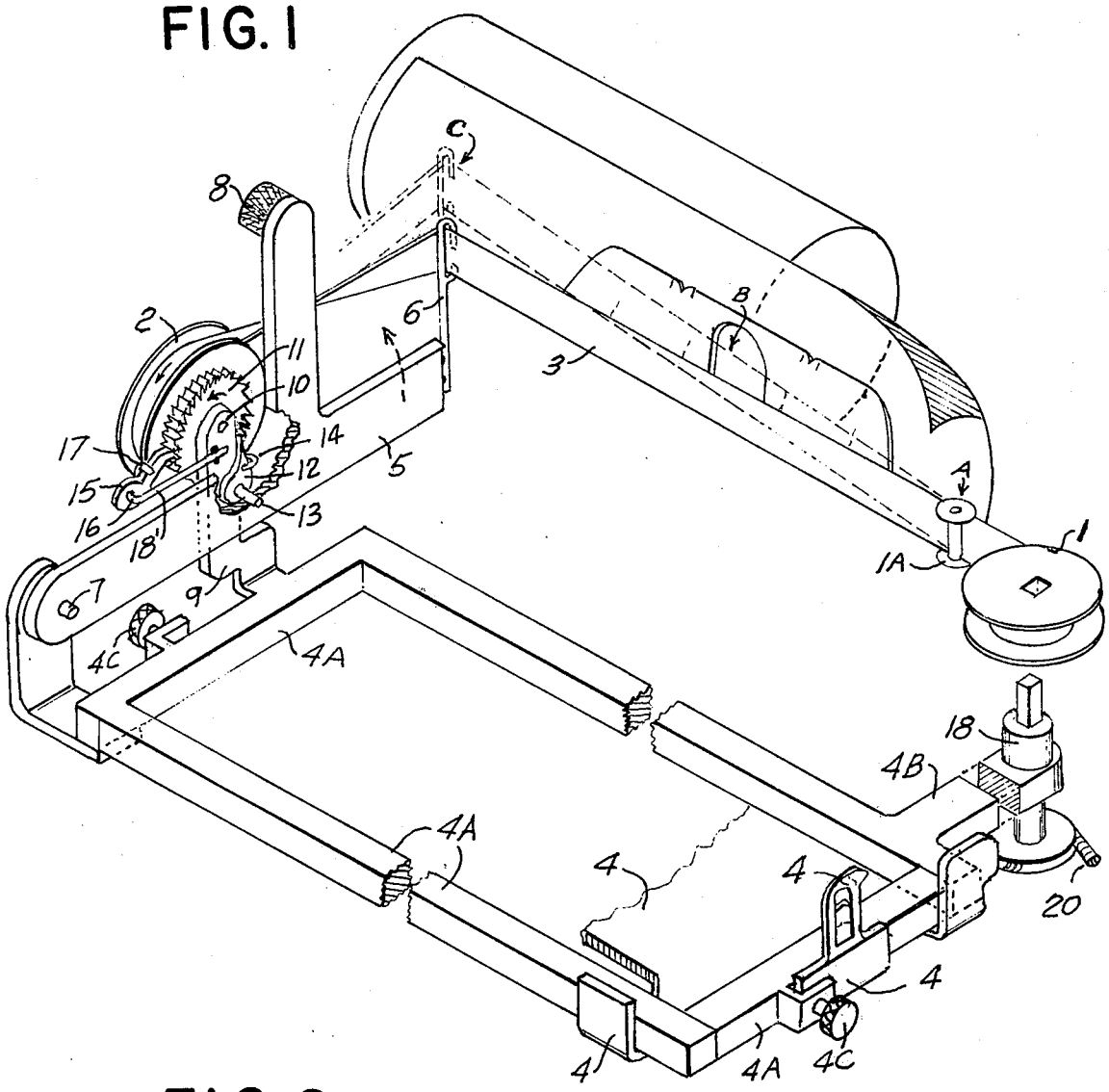
FIG. 1 is a schematic perspective view, partly in section and with parts broken away for clarity, of one form of the invention.

Element 1 is the supply spool for correcting tape 3; 2 is the take-up spool for the correcting tape 3; 4 is the carrier for the entire printing assembly, including the usual mount for the single-element printing element (not shown); 4A is an auxiliary support frame arranged to be easily installable or superimposed in a removable manner on carrier 4, and which auxiliary support frame will carry various elements of my invention. Simple knurled set-screw arrangements 4C are shown in FIG. 1 for securing auxiliary frame 4A to carrier 4, merely by way of illustration.

Figure 2:
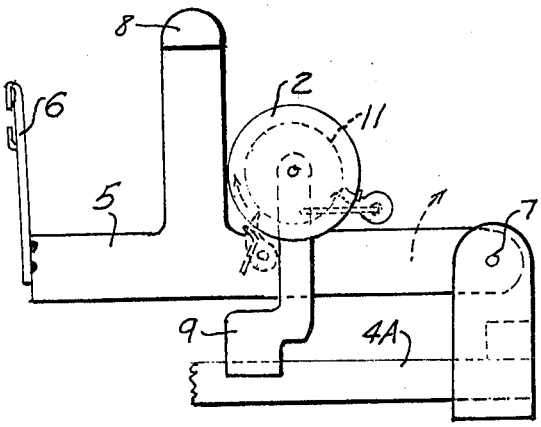
FIG. 2 is a view in side elevation of part of the FIG. 1 structure, looking from the opposite direction.

Item 5 is a carrying arm for take-up spool 2 for the tape 3; 6 is an elevating guide for tape 3; 7 is a fulcrum for arm 5 on frame 4A, and 8 is a handle on arm 5 to lift said arm 5 when needed; 9 is the bracket of frame 4A which supports take-up spool 2; and 10 is the shaft on which spool 2 rotates; 11 is a ratchet-tooth drive member on shaft 10 on which removable take-up spool 2 is secured in driven relation. FIG. 2 is a view from the opposite side from that represented in FIG. 1.

Element 12 is an offset-tooth pawl pivoted on arm 5 to engage the teeth on drive 11; 13 is the fulcrum of pawl 12; 14 is a spring urging pawl 12 against the teeth on drive member 11; 15 is another pawl, spring-loaded at 17 against the ratchet-teeth of 11 to inhibit the drive member 11 from being dragged in the retrograde direction (clockwise in FIG. 1); 16 is the fulcrum for pawl 15; and 18' represents the mounting on bracket 9 for 15, 16 and 17. It may be, as shown, a side arm welded or staked to the bracket.

It will be noted that the supply spool 1 is shown on a horizontal plane, while the take-up spool 2 is on a vertical plane. Also, that arm 5 is provided with the elevating guide 6 which will move (elevate) correcting tape 3 up into use (correcting) position. Obviously, either or both spools 1 and 2 could be horizontal, inclined or vertical planes, or vice-versa. However, FIG. 1 shows a preferred construction that accomplishes feeding motion of ratchet 11 in a most direct manner; and which provides more motion for arm 5 to accomplish the lifting of pawl 12 to insure adequate feeding movement of the correcting tape 3 so as to provide a fresh area for each desired correcting stroke of the typewriter.

FIG. 1 shows in dash lines arm 5 having been lifted by handle 8 to bring tape 3 up to correcting position. It will be noted that point A of tape 3 is defined by an idler roller or guide 1A at a fixed point from which there is no vertical tape movement, and that point C shows the maximum vertical movement of tape 3. Accordingly, since point B is about at the center-point or midway between A and C, it follows that its vertical movement at point B will be approximately one-half that at point C. This observation is being made at this juncture for the reason that as I disclose more automatic means for feeding and indexing the tape 3, it will be seen that the vertical throw of arm 5 will vary, and it is helpful in the use of my invention that at point B the distance-of-travel-vertically is always approximately one-half of that at point C.

It will be seen that in the raising of arm 5 pawl 12 turns ratchet 11 in order to advance tape 3 to a fresh, unused area, and pawl 15 will inhibit ratchet 11 from being dragged in a clockwise direction on the lowering of pawl 12.

Figure 3:
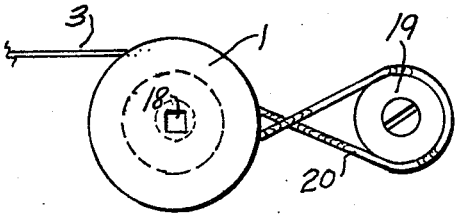
FIG. 3 is a partial plan view, to a somewhat larger scale, showing further details of that same form of the invention.
Figure 8:
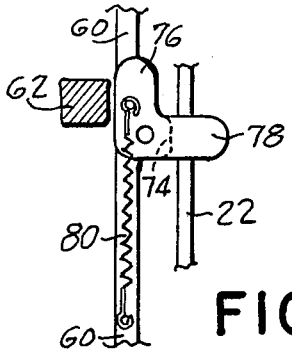
FIG. 8 is a fragmentary view in plan of portions of FIG. 7, with a part in section taken on the line 8—8 of FIG. 7, and showing the parts in a different position of adjustment.

At the other end of auxiliary frame 4A, 18 shows a shaft on 4A designed to hold supply spool 1, and 19 (see FIG. 3) shows a sheave fixed as by a screw on platform or frame 4A; 20 shows a coiled spring in a FIG.-8 configuration, which servers not only to inhibit free-feeding of tape 3 from spool 1, but further causes a slight positive reverse pull to keep tape 3 taut at all times. The side arm 4B of auxiliary frame 4A which mounts the supply spool is shown broken away, because it must hold the supply spool at a level which requires it to be offset from the general plane of 4A. The rotating shaft 18 is also shown with its squared end disengaged from the supply spool for clarity of illustration; the supply spool normally rests on the shoulder of shaft 18.

It will be noted that up to this point I have disclosed a simple device of limited automaticity, designed so that tape 3 will be held in indexed position (for making the correction) by the operator, and the advance of tape 3 having been accomplished by the act of the operator in lifting arm 5 to the indexing position. Accordingly, no detents are shown to hold arm 5 in the elevated indexing position because (a) this would obscure the vision of the operator with reference to the corrected character, and (b) if correction were required for more than one character, tape 3 would not then have been advanced a sufficient distance by the act of lifting up arm 5 the first time.

I will now explain how further automaticity may be gained, both in the feeding of tape 3 and revealing (making visible) the writing/or correcting line, and I start by referring to FIG. 4:

In this Figure, item 3 is intended to be the same tape as in FIG. 1, but arm 5, while serving the primary function of elevating 3 will be somewhat altered and will therefore be designated hereafter as "21". In FIG. 4 we have a view showing the top edge of 21. 22 is one arm of the vibrator originally in the Selectric machine, and 23 is the right-hand arm of the same; (in the existing machine these arms work as one unit). Shown at 25 is the fulcrum axis of 22/23. 26 is the shaft upon which the entire carrier assembly 4 rides; (an auxiliary support shaft is now shown). 24 is the marking (printing) ribbon of existing Selectrics, and it should be noted that the marking ribbons on existing Selectrics may be of different types, such as fabric, "one-time" carbon ribbons, or "repetitive" carbon ribbons.

It should also be noted that vibrator 22/23 (as well as the usual horizontal-feed mechanism for marking ribbon 24 — which mechanism is not shown) varies in size and function in various models of the Selectric. To illustrate, in one model the vibrator moves vertically a fixed distance on each strike of the machine. The constant distance can be fixed at one of three vertical ranges (or the vibrator can be adjusted not to move at all), but once fixed, it is the same at each strike. In some models there is a ribbon feed horizontally in both directions, so that a fabric or other ribbon can be used back and forth between spools.

In still other models, ribbon feed is in only one direction (generally from left spool to right) and also the vibrator operates sucessively to print from the marking ribbon from top to middle to bottom of ribbon and then repeating the procedure on each strike of the machine, and advancing the ribbon to an unused portion after each three such strikes or spacing operations. Still another model operates the vibrator in this same manner, but delays the advancing of the ribbon until after approximately 18 strikes (or spacing operations) of the machine.

In any case, the invention I disclose here will work equally efficiently regardless of such variations in the type of marking ribbon for which the machine has been designed, the manner of feed (horizontally) of the ribbon, or the variations of the "throws" of the vibrator.

It will be seen from FIG. 4 that correction tape 3 is disposed between marking ribbon 24 and the typewriter platen 27. Impression sheet 27′ will be disposed between the platen 27 and ribbon 3. In all versions of my present invention, it is contemplated that ribbon 24 will be indexed in front of tape 3 on every striking operation of the machine. However, the distance-of-travel of vibrator 22/23 need not be identical to the distance-of-travel of tape 3 in one version of my invention. In another form, which I will describe, it will be identical.

FIG. 4 shows arm 21 having a bearing hub loose on shaft 7 (the same shaft as in FIG. 1). It shows helical spring 33 also on shaft 7 to the right of arm 21 (as in Fig. 5), and biased against stop 34 so that it forces arm 21 always to the left in this figure. Arm 21 now has a lateral extension lug 27 at its top, disposed in such a manner that when arm 21 is moved to the right, FIG. 5, extension lug 27 is directly over vibrator arm 22.

It should be noted that in this configuration, the tooth of pawl 12 (see FIG. 2) must be of such width that it will be kept in constant articulation (engagement) with ratchet teeth of 11, at all times when arm 21 is being moved from left to right. Pawl 15, being in a fixed lateral position relative to the ratchet teeth on 11, need be no wider. Arm 28 (refer now to FIG. 4) is pivoted on a pin 29 which is affixed to an extension of auxiliary support frame 4A. A pin 30 on arm 28 is designed so that when arm 28 is pushed clockwise or to the right on fulcrum pin 29, it will move arm 21 to the right against spring 33, and the lateral extension 21′ of arm 21 will be positioned over the vibrator arm 22 of the typewriter. Accordingly, whenever arm 22 moves vertically, it will lift arm 21, no matter how high it moves vertically. 31 is a detent recess in a downward extension of arm 28, and 32 is a detent spring cooperating with said recess to hold arm 28 deflected to the right.

As shown in FIG. 4, when arm 28 moves pin 30 to the right, detent recess 31 moves to the left, and ultimately becomes engaged with detent spring 32, holding arm 28 and pin 30 in a fixed position. However, it will be noted that even if pin 30 is only travelled a bit beyond center, and does not become detented, it will nevertheless insure that for the time being lug 21' will be in the required position to be engaged by vibrator arm 22 when it moves upwards, so long as arm 28 is held deflected by the operator.

Regardless of how far arm 28 may be deflected by the operator, it will be seen that automaticity has been gained in the feeding of tape 3 by the vibrator-actuated lifting and lowering of elevating arm 5 of FIG. 1. But in the detented mode, the operator is free to use all his fingers on the keyboard so that he or she can more efficiently make lengthy corrections. He would of course have to operate arm 28 back to the left after he had finished all of a group of corrections.

Automaticity even approximately the equal of the new "Correcting Selectric" typewriters can be achieved, however, by the introduction of another set of function levers, also illustrated in FIG. 4.

From an upper portion of arm 28 extend in opposite directions a pair of bent levers 36 and 37, so arranged that when arm 36 is depressed, it tilts arm 28 in one direction about its pivot pin 29, while depression of arm 37 tilts arm 28 in the opposite direction. Extending parallel to the machine's platen 27 are two slim rods 41 and 42, parallel to one another and connected together at their ends by respective bent yokes 35 and 35'. Yokes 35, 35' are far enough apart to enable them to engage bent levers 36 and 37 regardless of the position taken up by the auxiliary frame 4A and the printing element during typing.

The bent yokes at the ends of the slim rods are pivoted as at 37, 37' on two hangers 39 and 40 which in turn are fixedly mounted on the underside either of the pivoted cover 42 of the typewriter (see FIG. 6), or the fixed casing 44 of the same. For example, the hangers may be suspended from the casing parts by the use of high-strength adhesive or any other convenient fastening means. Or, the hangers may be made relatively integral with the pivoted cover part of a typewriter which cover part is marketed as a one-time replacement for the existing pivoted cover of a Selectric machine. In either case, the actuation of the bent yokes, to move arm 28 into "correcting" position, and back again, is preferably accomplished by respective key stems 46 and 48 (see also FIG. 6) which on each actuation also depress the normal backspace key 50 of the machine. These key stems may conveniently emerge through the clearance slot 52 through which extend the normal margin-adjusting devices 54 and 56 of the typewriter.

Alternatively, the actuation of the bent yokes 35 and 35' may be accomplished through electrical control, the use of Bowden cables (flexible cables such as commonly employed for camera shutter-releases), or the like.

It is perhaps hardly necessary to mention that of course there is a driving connection between the ratchet drive wheel 11 and the tape take-up spool 2. This connection may be a splined shaft, any non-circular shaft, or even one or more drive pins on the ratchet wheel engaging corresponding holes in the take-up spool.

Figure 7:
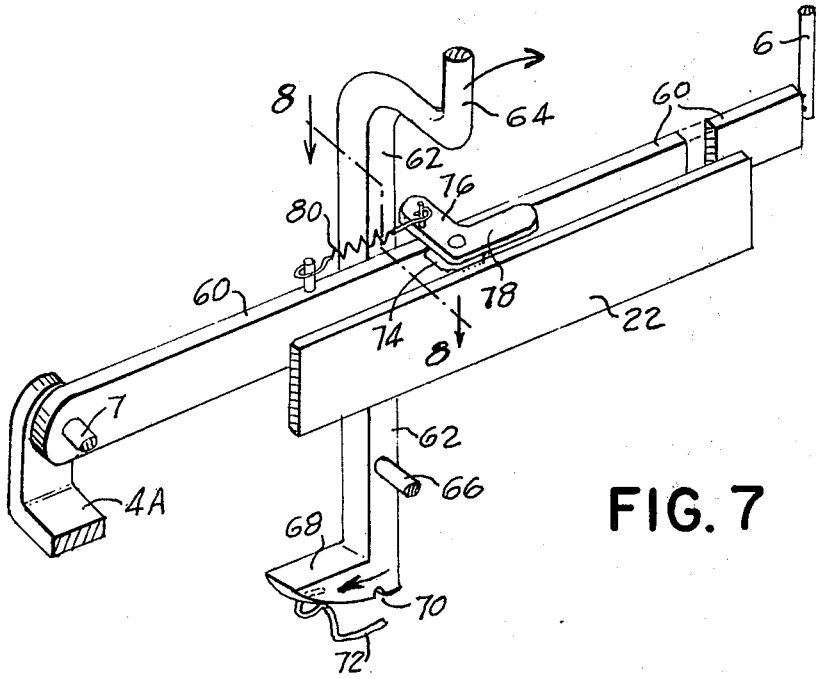
FIG. 7 is a schematic perspective view, with parts broken away, of still another form of the invention.

FIGS. 7 and 8 illustrate still another form which the invention may take. Here again, parts which are the same as ones earlier described bear the same reference numbers; thus, 4A represents a support or framework which is applied to the carrier of an existing typewriter of the non-correcting Selectric, single-element type; in particular, it represents the same bracket portion of frame 4A which is shown in FIG. 1 as directly supporting at fulcrum 7 an arm whose opposite end carries the correction tape-elevating guide 6. In the case of FIGS. 7 and 8, this arm is designated by numeral 60, because it differs specifically from the arm 5 of FIGS. 1 and 2, and also from arm 21 of FIGS. 4 and 5.

For the same reason, the vertically-extending control arm 28 of FIG. 4 is now replaced in FIGS. 7 and 8 by vertically-extending control arm 62, whose upper end is for convenience bent so as to form an operating handle portion 64. The arm 62 is pivoted for fore-and-aft swinging about a fulcrum 66, also carried by the auxiliary support frame 4A.

At its lower extremity, control arm 62 has an arcuate extension 68, whose lower edge contains the detent groove 70 cooperating with a detent spring 72. These parts are generally comparable to elements 31 and 32 of FIG. 4, but as will be seen the construction now being described avoids the need for certain complications due to the use in FIG. 4 of an arm 21 which must partake of both a vertically swinging motion and a lateral sliding motion.

Returning now to the description of arm 60, it is provided with a laterally-extending or turned-out lug 74, which approaches, but does not not touch, the adjacent arm 22 of the ribbon vibrator assembly of the existing Selectric typewriter as previously described. Upon the upper surface of this lug 74, there is pivoted a two-armed bell crank 76, 78, which is urged to the position shown in FIG. 7 by a spring 80 extending from arm 76 to a pin (for example) or other formation on arm 60. The construction is such that in the condition shown in FIG. 7, crank arm 78 is not engaged by vibrator arm 22 during typing operations with the correction mechanism disengaged.

When, however, correction of a mistake is needed, the carrier is backspaced as usual, and arm 62 is swung forward (in the direction of the arrow at the top of FIG. 7). Now, as best shown in the top view of FIG. 8, arm 62 has been swung in the direction to cam crank arm 76 to the right in FIG. 8, and cause crank arm 78 to overlie vibrator arm 22. When the erroneous character is retyped (that is, erased by the action of the correcting tape as heretofore described), it is vibrator arm 22 which furnishes the power lifting arm 60.

The above actions occur so long as arm 62 is held in the position which causes crank arm 78 to overlie arm 22. When several characters have to be erased, the arm 62 is swung to the fully forward position of FIG. 8, whereupon the detent spring 72 will cause it to be retained in that position allowing the typist to use both hands, if desired, on the keyboard of the machine.

What is claimed is:

1. In a typewriter of the kind having a keyboard, a carrier translatable in the linewise direction across an impression sheet, a single-element character imprinting member mounted on said carrier, and means, including a first ribbon vibrator, for feeding a marking ribbon between said imprinting member and said impression sheet, said means forming a part of said carrier, and means for raising said first vibrator during printing operations, the improvement which comprises:

a. an auxiliary support readily installable on and secured to said carrier, and which moves in a linewise direction with the carrier when the carrier moves in a linewise direction, and which does not impair the movement of the carrier in a linewise direction, b. a correction tape supply spool and a correction tape take-up spool disposed on said auxiliary support so as to direct between them a correction tape along a path beneath the linewise location of character imprints, c. means on said auxiliary support for momentarily elevating said correction tape so as to present a portion thereof between said imprinting member and the impression sheet, to thereby obliterate a character imprint upon the next operation of said imprinting member, comprising a second ribbon vibrator, said second ribbon vibrator being adapted to receive the correcting tape, and control means selectively connecting the second ribbon vibrator to the first vibrator to raise the correcting tape into printing position when a correction is to be made, d. means on said auxiliary support, connected to said elevating means, for advancing said correction tape at increments so as to present a fresh correcting surface upon each elevating operation thereof, e. said auxiliary support including mounting means for each of said correction tape supply spool, said correction tape take-up spool, said means for momentarily elevating said correction tape, and said means for advancing said correction tape, to permit them to operate in the various linewise positions to which the carrier moves.

2. The improvement in accordance with claim 1 comprising means operable from the keyboard for operating said control means.

3. In a typewriter of the type having a keyboard as defined in claim 1, said control means including a manually operable handle mounted on and extending away from said auxiliary support and manually movable to connect said second ribbon vibrator to the first one for joint motion during the obliteration of an error.

4. In a typewriter of the kind having a keyboard as defined in claim 1, said keyboard having a backspace key, first and second control keys, means mounting said first and second control keys on the typewriter in a position so that depression of either of said first or second keys will depress said backspace key, and means for operating said control means to connect said second ribbon vibrator to the first vibrator when said first key is depressed and to operate the control means to disconnect the ribbon vibrators from each other when said second key is depressed.

5. In a typewriter of the kind having a keyboard as defined in claim 1, said first-named ribbon vibrator comprising an arm on said carrier, one end of said arm being pivotally mounted adjacent the side of the carrier closest to the keyboard, for movement in a vertical plane, said arm carrying the marking ribbon at its end farthest from said keyboard, said second-named ribbon vibrator comprising an arm one end of which is pivotally mounted on said auxiliary support near the side thereof closest to the keyboard, said last-named arm carrying said correction ribbon at its end farthest from the keyboard, said control means including connecting means carried by the last-named arm and movable to a position above the first-named arm so that when said connecting means is moved above the first-named arm the two arms will move simultaneously

6. In a typewriter of the kind having a keyboard, a carrier translatable in a linewise direction across an impression sheet, a single element character imprinting member mounted on said carrier, first means including a first ribbon vibrator for feeding a marking ribbon between said imprinting member and said impression sheet and for raising said first ribbon vibrator during a printing operation, means including a second ribbon vibrator for feeding a correcting ribbon between the printing ribbon and the impression sheet, the improvement comprising:

control means selectively operable when an error is to be obliterated to connect said second ribbon vibrator to a part of said first means that moves only when the first ribbon vibrator moves so that said first means will raise the second ribbon vibrator along with the first vibrator

7. In a typewriter as defined in claim 6, each said ribbon vibrator having elongated arms, each elongated arm having first and second ends, said arms being adjacent each other, each arm having its first end pivotally mounted, the second end of the arm of the first vibrator carrying the marking ribbon, the second end of the arm of the second vibrator carrying the correcting tape, said control means including driving means for connecting said arm of said second ribbon vibrator to the arm of the first ribbon vibrator so that the arm of the first ribbon vibrator drives the second ribbon vibrator to a raised position when an error is to be obliterated.

* * * * *